United States Patent [19]

Beisel

[11] Patent Number: 4,711,174

[45] Date of Patent: Dec. 8, 1987

[54] DEVICE FOR ENGAGING AND DISENGAGING THE FORM ROLLERS IN AN INKING UNIT OF A PRINTING MACHINE

[75] Inventor: Hermann Beisel, Walldorf, Fed. Rep. of Germany

[73] Assignee: Heidelberger Druckmaschinen AG, Heidelberg, Fed. Rep. of Germany

[21] Appl. No.: 779,234

[22] Filed: Sep. 23, 1985

[30] Foreign Application Priority Data

Sep. 21, 1984 [DE] Fed. Rep. of Germany ..... 3434645

[51] Int. Cl.[4] ..... B41F 31/00; B41F 31/14

[52] U.S. Cl. ..... 101/352; 101/358; 101/362

[58] Field of Search ..... 101/348, 351, 352, 357, 101/358, 361, 362

[56] References Cited

U.S. PATENT DOCUMENTS

| | | | |
|---|---|---|---|
| 2,162,812 | 6/1939 | Harrold et al. | 101/351 |
| 2,915,970 | 12/1959 | Mestre | 101/352 X |
| 2,965,023 | 12/1960 | Boule et al. | 101/352 |
| 3,491,686 | 1/1970 | Zurick | 101/352 |
| 3,595,164 | 7/1971 | Hovekamp | 101/352 X |
| 4,458,591 | 7/1984 | Guaraldi | 101/352 X |
| 4,475,456 | 10/1984 | Ishii et al. | 101/352 X |
| 4,524,712 | 6/1985 | Ito | 101/352 X |
| 4,567,823 | 2/1986 | Hummel et al. | 101/352 X |

FOREIGN PATENT DOCUMENTS

| | | | |
|---|---|---|---|
| 7079 | 1/1984 | Japan | 101/352 |
| 145150 | 8/1984 | Japan | 101/352 |
| 37358 | 4/1937 | Switzerland | 101/352 |

*Primary Examiner*—Edgar S. Burr
*Assistant Examiner*—James R. McDaniel
*Attorney, Agent, or Firm*—Herbert L. Lerner; Laurence A. Greenberg

[57] ABSTRACT

A device for engaging form rollers in an inking unit of a printing machine with a plate cylinder of the printing machine and for disengaging the form rollers therefrom, including bearing levers for the form rollers disposed at both side frames of the printing machine, the form rollers being pivotable on bearings of mutually adjacent distributor rollers and being engageable with and disengageable from the plate cylinder by an adjustment element includes at each side frame, a pair of control levers to each of which the two bearing levers, respectively, are articulatingly connected via respective straps, both of the control levers being pivotally mounted on respective stud bolts at the side frames of the machine; a compensating web, respectively, coupling the pair of control levers at each of the side frames; and a respective control cylinder engaging the compensating web and supported on one of the side frames.

3 Claims, 2 Drawing Figures

DEVICE FOR ENGAGING AND DISENGAGING THE FORM ROLLERS IN AN INKING UNIT OF A PRINTING MACHINE

The invention relates to a device for engaging form rollers in an inking unit of a printing machine and for disengaging the form rollers therefrom, including bearing levers for the form rollers disposed at both side frames of the printing machine, the form rollers being pivotable on bearings of mutually adjacent distributor rollers and being engageable with and disengageable from the plate cylinder by an adjustment element.

A conventional construction of this general type is disclosed in German Published Non-Prosecuted Application No. 1 949 092 wherein an inking unit with three form or ink applicator rollers is mounted on levers which are secured to side frames of a machine. Assigned to the bearing levers are respective control levers which are operatively connected to one another. To facilitate engagement and disengagement of the rollers, a cam disk is provided, on both sides, a-roller, secured to one of the control levers, rolling on the cam disk. The form rollers can be engaged or disengaged by simultaneously turning the two cam discs on both sides of the machine. In order, however, to ensure that the roller will be in contact with the cam disc and the control levers, respectively, several tension springs are required, which bring the control levers provided on both sides of the machine into contact.

A disadvantage of the foregoing conventional construction basically lies in the unstable bearing mount of the form roller. If these rollers, in their engaged position, roll on the printing plate, knocking can occur, for example, when they pass through the plate-cylinder channel, leading to vibrations of the rollers and of the roller bearings, respectively, so that impairment of inking itself can occur when the individual form inking rollers are set onto the printing plate. Particularly in the case of high-speed machines, this can cause roller streaks which make the production of high quality printings impossible.

Starting from this state of the art, it is an object of the invention to provide a bearing mount and engagement and disengagement of the form rollers, particularly in the case of a four-form roller inking unit, which ensures uniform and optimum inking of the printing form.

With the foregoing and other objects in view, there is provided, in accordance with the invention, a device for engaging form rollers in an inking unit of a printing machine with a plate cylinder of the printing machine and for disengaging the form rollers therefrom, including bearing levers for the form rollers disposed at both side frames of the printing machine, the form rollers being pivotable on bearings of mutually adjacent distributor rollers and being engageable with and disengageable from the plate cylinder by an adjustment element, comprising at each side frame, a pair of control levers to each of which the two bearing levers, respectively, are articulatingly connected via respective straps, both of the control levers being pivotally mounted on respective stud bolts at the side frames of the machine; a compensating web, respectively, coupling the pair of control levers at each of the side frames; and a respective control cylinder engaging the compensating web and supported on one of the side frames.

This construction according to the invention provides a vibration-free engagement and disengagement of the form rollers, ensuring uniform contact of the form rollers with advantageous force distribution in the control or adjusting elements and which is actuatable by remote control.

In accordance with another feature of the invention, there are provided respective eccentric stops engaged by the bearing levers at both of the side frames of the printing machine, and control spindles for adjusting the eccentric stops.

This feature permits rigid contact of the bearing levers of the form rollers, particularly in the engaged position, so that vibrations are reduced, and permits a sensitive adjustment even while the machine is running.

In accordance with a concomitant feature of the invention, there is provided an inking unit roller in contact with the form rollers and being mounted so as to be shiftable against a force for effecting the contact and so as solely thereby to follow engagement and disengagement movements of a pair of form rollers.

With this feature, disengagement of the form rollers is improved to the extent that no separate control is necessary for further form rollers adjacent the first-mentioned form rollers.

Other features which are considered as characteristic for the invention are set forth in the appended claims.

Although the invention is illustrated and described herein as embodied in a device for engaging and disengaging the form rollers in an inking unit of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
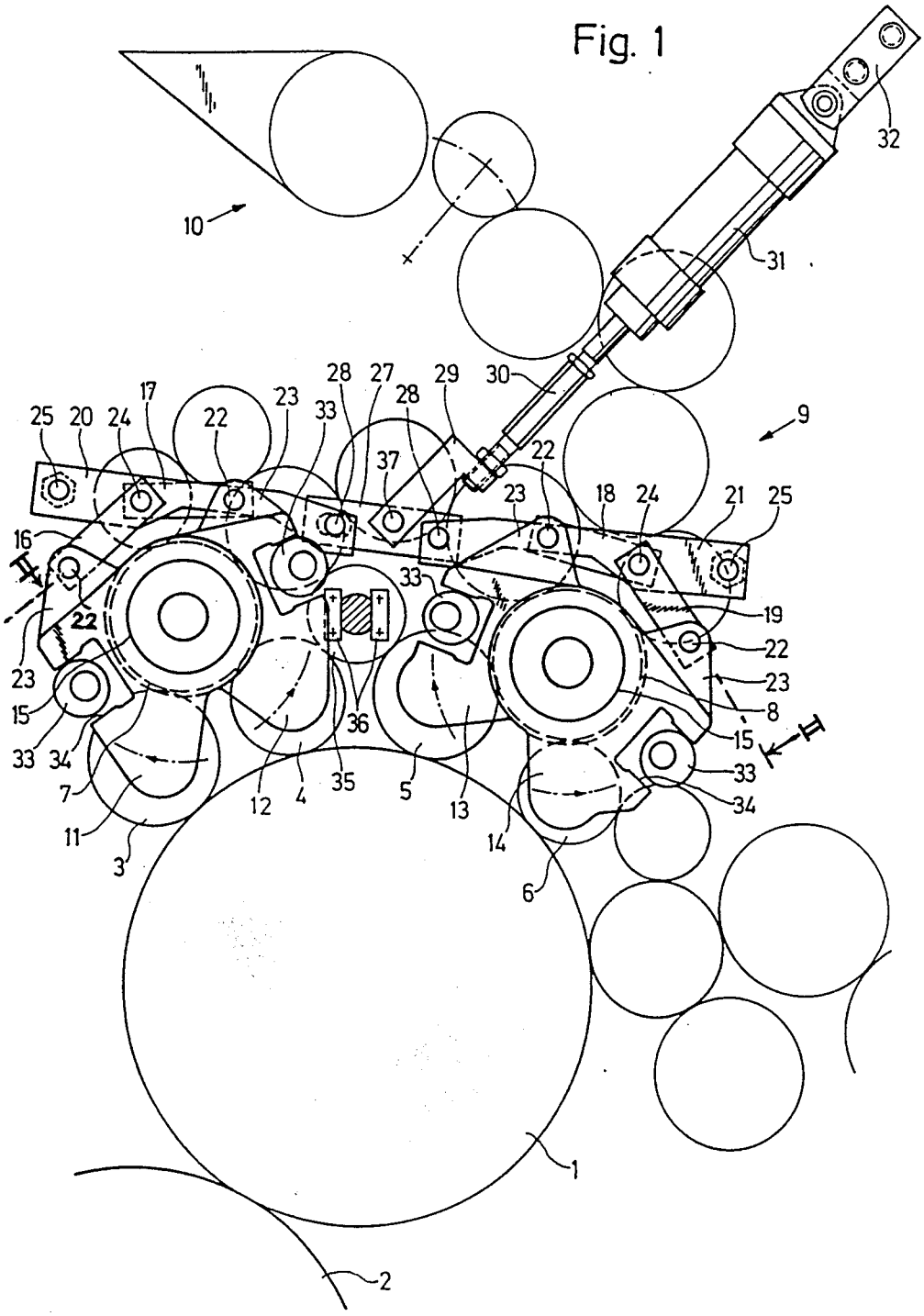
FIG. 1 is a diagrammatic side elevational view of an inking device embodying the invention.

Referring now to the figures of the drawing, it is noted that the embodiment of the invention is shown, by example, in an offset printing unit with a plate cylinder 1 and a rubber or blanket cylinder 2 both of conventional construction. In order for the printing unit to perform high quality printing work, four form or ink applicator rollers 3, 4, 5 and 6 which are mounted so as to pivot about 2 brayers or distributor rollers 7 and 8 are operatively associated with the plate cylinder 1. The distributor rollers 7 and 8 are driven by a non-illustrated inking unit drive at the speed of the printing machine. In a conventional manner, the brayers or distributor rollers 7 and 8 are supplied with a given quantity of ink by an ink metering device 10 via a large number of inking unit rollers 9.

Figure 2:
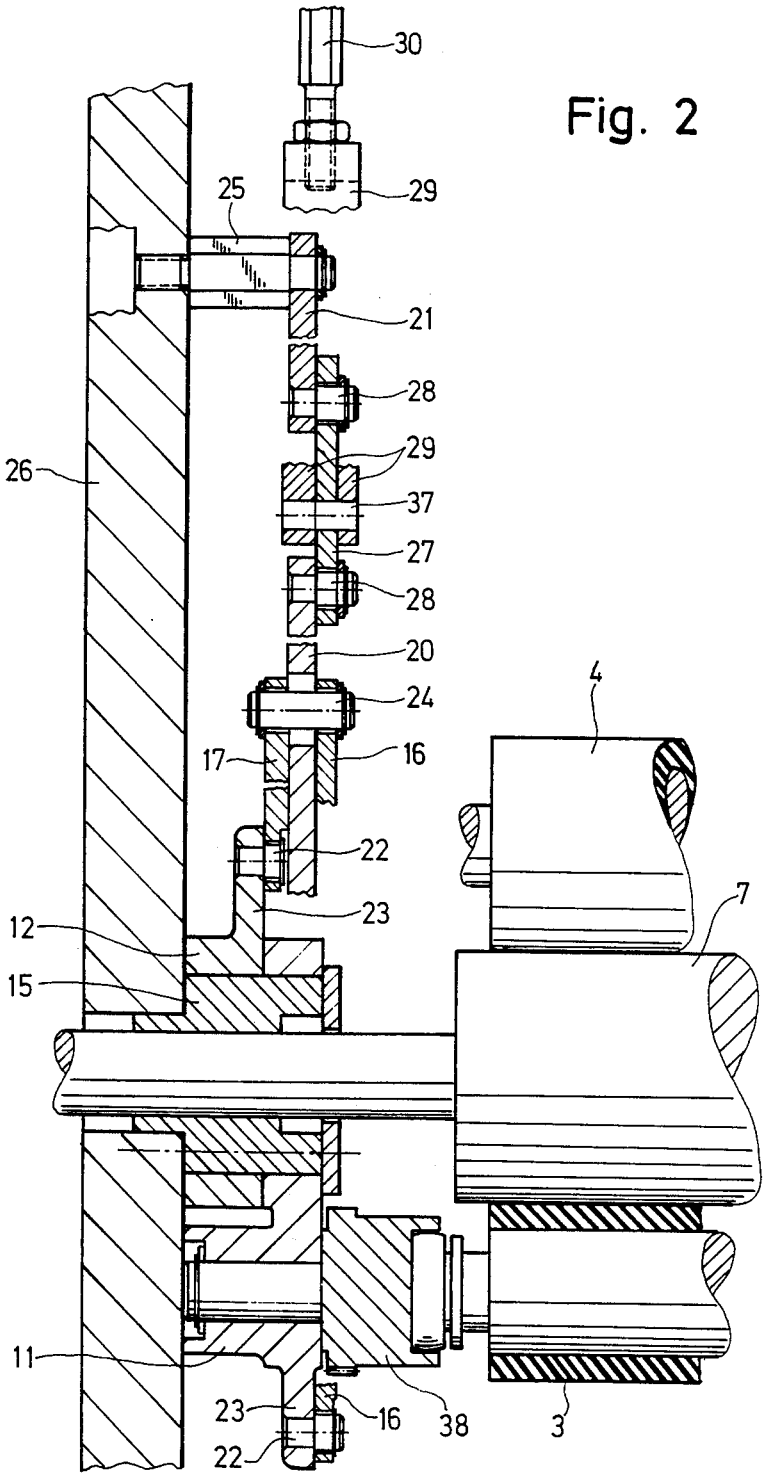
FIG. 2 is an enlarged fragmentary cross-sectional view of FIG. 1 taken along the line II—II in direction of the arrows.

The form rollers 3 to 6 are mounted in bearing levers 11 to 14, respectively, which are arranged so that they can pivot or swivel about bearings 15 of the distributor roller 7, 8 adjacent thereto. Two bearing levers 11 and 12, on the one hand, and 13 and 14, on the other hand, which are, respectively, provided on both side frames of the machine, are each connected to a respective control lever 20, 21 by means of straps or fishplates 16 to 19, which are secured by pins 22 to cams 23, which are provided, respectively, on the bearing levers 11 to 14. The straps 16 to 19 are linked to the control levers 20, 21, as shown, by pins 24. The control levers 20 and 21 themselves are secured by stud bolts 25 to the machine side frame 26 (FIG. 2). A compensating web or strip 27 which is connected by stud bolts 28 to the ends of the respective control levers 20 and 21 opposite the ends by which they are mounted at the stud bolts 25 is disposed between both of the control levers 20 and 21. A piston rod 30 of a control cylinder 31 engages this compensating web 27 via an articulating or joint body 29. The cylinder 31, in turn, is supported by a bearing body 32 on the machine side frame 26.

By actuating the control cylinder 31, the compensating web 27 is forced downwardly to effect engagement of the form rollers 3 to 6 with the plate cylinder 1 so that the two control levers 20 and 21 are moved in a manner like that of a toggle lever. In this way, these levers 20 and 21 press the bearing levers 11 to 14 downwardly via the pins 24 and the straps 16 to 19 so that the ink form rollers 3 to 6 make contact with the plate cylinder 1. The engagement movement is limited by eccentric stops 33 which are received in recesses 34 formed in the bearing levers 11 to 14. By turning the eccentric stops 33 with the aid of non-illustrated control spindles, the contact force of the form rollers 3 to 6 on the printing plate of the plate cylinder 1 can be sensitively adjusted.

When pressure is applied to the control cylinder 31 in the opposite direction, the opposite course of movement of the individual control elements occurs, the stops 33 being received in the recesses 34 of the bearing levers 11 to 14 also in the disengaged position.

In an advantageous configuration of the invention, an inking unit roller 35 resting on the form rollers 4 and 5 is slidably mounted via slide members 36 so that it can follow the engagement and disengagement movement of the form rollers without its own control elements.

As shown in FIG. 2, the joint body 29 is connected to the compensating web 27 by means of a pin 37. This figure also shows that the ink form rollers 3 to 6 are preferably interchangeably mounted in bearings 38 in the bearing levers 11 to 14.

I claim:

1. Device for alternatingly engaging form rollers in an inking unit of a printing machine with a plate cylinder of the printing machine and for disengaging the form rollers therefrom, including bearing levers for the form rollers disposed at both side frames of the printing machine, an adjustable stop element engageable with each of said bearing levers the form rollers being pivotable on bearings of mutually adjacent distributor rollers and being engageable with and disengageable from the plate cylinder by an adjustment element, a pair of control levers at each side frame spaced from one another and pivotally mounted on respective stud bolts at the side frames of the machine; the two bearing levers at each side frame, being articulatingly connected via respective straps to each of said control levers, a compensating web, respectively, coupling said pair of control levers at each of the side frames; and a respective control cylinder supported on one of the side frames and engaging said compensating web for moving said control levers to force the respective form rollers alternatingly into engagement with the plate cylinder.

2. Device according to claim 1, said stop elements being eccentric stops engaged by the bearing levers at both of the side frames of the printing machine, and control spindles for adjusting said eccentric stops.

3. Device according to claim 1, including an inking unit roller in contact with said form rollers and being mounted so as to be shiftable against a force for effecting said contact and so as solely thereby to follow engagement and disengagement movements of a pair of form rollers.

* * * * *